US008125422B2

(12) United States Patent
Choi

(10) Patent No.: US 8,125,422 B2
(45) Date of Patent: Feb. 28, 2012

(54) SCAN DRIVER, ORGANIC LIGHT EMITTING DISPLAY USING THE SAME, AND METHOD OF DRIVING THE ORGANIC LIGHT EMITTING DISPLAY

(75) Inventor: Sang Moo Choi, Suwon-si (KR)

(73) Assignee: Samsung Mobile Display Co., Ltd., Yongin, Gyunggi-do (KR)

( * ) Notice: Subject to any disclaimer, the term of this patent is extended or adjusted under 35 U.S.C. 154(b) by 1028 days.

(21) Appl. No.: 11/364,590

(22) Filed: Feb. 28, 2006

(65) Prior Publication Data

US 2006/0248421 A1 Nov. 2, 2006

(30) Foreign Application Priority Data

Apr. 28, 2005 (KR) ..... 10-2005-0035769

(51) Int. Cl.
*G09G 3/32* (2006.01)

(52) U.S. Cl. ..... 345/82; 345/100

(58) Field of Classification Search ..... None
See application file for complete search history.

(56) References Cited

U.S. PATENT DOCUMENTS

| | | | | |
|---|---|---|---|---|
| 5,568,163 | A * | 10/1996 | Okumura | 345/100 |
| 5,654,659 | A | 8/1997 | Asada | |
| 2003/0178947 | A1 | 9/2003 | Shin et al. | |
| 2004/0001054 | A1* | 1/2004 | Nitta et al. | 345/204 |
| 2005/0062692 | A1 | 3/2005 | Lo et al. | |
| 2006/0158394 | A1* | 7/2006 | Choi | 345/76 |

FOREIGN PATENT DOCUMENTS

| | | | |
|---|---|---|---|
| EP | 1 424 674 | A | 6/2004 |
| EP | 1 662 463 | A2 | 5/2006 |
| EP | 1 667 092 | A | 6/2006 |
| JP | 05-119741 | A | 5/1993 |
| JP | 06-208340 | A | 7/1994 |
| JP | 2001-195043 | | 4/2000 |

(Continued)

OTHER PUBLICATIONS

Office Action issued by the State Intellectual Property Office of P.R. China on Jun. 6, 2008 for Chinese Application No. 200610072046.X.

(Continued)

*Primary Examiner* — Seokyun Moon
(74) *Attorney, Agent, or Firm* — Knobbe Martens Olson & Bear LLP

(57) ABSTRACT

A scan driver capable of freely setting the width of emission control signals and of dividing the emission control signals at least twice in one frame to apply the emission control signals is disclosed. Embodiments of the scan driver include a shift register, receiving at least two start pulses in one frame to sequentially shift the start pulses in response to a clock signal and to thus generate at least two sampling pulses, and at least two signal generators for combining the at least two sampling pulses and at least two output enable signals with each other to supply scan signals to scan lines, and for combining the at least two sampling pulses output from the shift register with each other to supply at least two emission control signals to emission control signals lines in one frame. At least two emission control signals are supplied to emission control signal lines in one frame so that it is possible to change the brightness of the display without generating a flicker.

22 Claims, 7 Drawing Sheets

FOREIGN PATENT DOCUMENTS

| | | | |
|---|---|---|---|
| JP | 2001-324958 | | 11/2001 |
| JP | 2001-324958 | A | 11/2001 |
| JP | 2003-280610 | | 3/2002 |
| JP | 2002-268615 | | 9/2002 |
| JP | 2002-268615 | A | 9/2002 |
| JP | 2004-163777 | | 11/2002 |
| JP | 2003-076331 | A | 3/2003 |
| JP | 2003-140619 | | 5/2003 |
| JP | 2003-157064 | | 5/2003 |
| JP | 2003-157064 | A | 5/2003 |
| JP | 2003-173154 | A | 6/2003 |
| JP | 2003-216100 | | 7/2003 |
| JP | 2003-216100 | A | 7/2003 |
| JP | 2003-223138 | | 8/2003 |
| JP | 2003-223138 | A | 8/2003 |
| JP | 2003-255899 | | 9/2003 |
| JP | 2003-255899 | A | 9/2003 |
| JP | 2004-094058 | A | 3/2004 |
| JP | 2004-151693 | A | 5/2004 |
| JP | 2004-226673 | A | 8/2004 |
| JP | 2004-318093 | | 11/2004 |
| JP | 2004-318093 | A | 11/2004 |
| JP | 2005-049838 | | 2/2005 |
| JP | 2005-338837 | A | 12/2005 |
| JP | 2006-011368 | A | 1/2006 |
| JP | 2006-072321 | A | 3/2006 |
| KR | 10-2002-0094601 | | 12/2002 |
| WO | WO 98/36407 | | 8/1998 |
| WO | WO 03/027998 | A1 | 4/2003 |

OTHER PUBLICATIONS

Office Action dated Dec. 8, 2009 of Japanese Patent Application No. 2006-104426 for corresponding Korean Application No. 10-2005-0035769.

Office Action dated Dec. 24, 2008 for related U.S. Appl. No. 11/305,890, filed Dec. 16, 2005.

Office Action dated Jul. 10, 2009 for related U.S. Appl. No. 11/305,890, filed Dec. 16, 2005.

Office Action dated Oct. 28, 2009 for related U.S. Appl. No. 11/305,890, filed Dec. 16, 2005.

Office Action dated Apr. 29, 2010 for related U.S. Appl. No. 11/305,890, filed Dec. 16, 2005.

Office Action dated Sep. 22, 2010 for related U.S. Appl. No. 11/305,890, filed Dec. 16, 2005.

* cited by examiner

SCAN DRIVER, ORGANIC LIGHT EMITTING DISPLAY USING THE SAME, AND METHOD OF DRIVING THE ORGANIC LIGHT EMITTING DISPLAY

CROSS-REFERENCE TO RELATED APPLICATIONS

This application claims the benefit of Korean Patent Application No. 10-2005-35769, filed on Apr. 28, 2005, in the Korean Intellectual Property Office, the disclosure of which is incorporated herein by reference.

BACKGROUND

1. Field of the Invention

The present invention relates to a scan driver, an organic light emitting display using the same, and a method of driving the organic light emitting display.

2. Discussion of the Related Technology

Various flat panel displays (FPD) having smaller weight and volume compared with cathode ray tubes (CRT) have been developed recently. In particular, of FPDs, the class of light emitting displays have high emission efficiency, brightness, and response speed and large viewing angles.

Light emitting displays can be classified into two categories: (1) organic light emitting displays using organic light emitting diodes (OLEDs) and (2) inorganic light emitting displays using inorganic light emitting diodes. In the first category, the OLED display includes an anode electrode, a cathode electrode, and an organic emission layer. The organic emission layer is positioned between the anode electrode and the cathode electrode where it emits light by a combination of electrons and holes. In the second category, the inorganic light emitting diode referred to as a light emitting diode (LED) includes an emission layer formed of inorganic material such as a PN-junction semiconductor, as opposed to the organic emission layer of the OLED.

FIG. 1 schematically illustrates the structure of a conventional scan driver for a display composed of OLED pixels.

Referring to FIG. 1, the conventional scan driver includes a shift register 10 and a signal generator 20. The shift register 10 sequentially shifts a start pulse received from an external source in response to a clock signal CLK to generate sampling pulses. The signal generator 20 generates scan signals and emission control signals in response to the sampling pulses supplied from the shift register 10, the start pulse SP, and an output enable signal OE supplied from an external source.

The shift register 10 includes n (where 'n' is a natural number) D flip-flops (DF). Here, the D flip-flops DF1 to DFn are driven when the clock signal CLK and the sampling pulses (or the start pulse) are supplied from the outside. The odd D flip-flops DF1, DF3, . . . are driven at the rising edge of the clock signal CLK and the even D flip-flops DF2, DF4, . . . are driven at the falling edge of the clock signal CLK. That is, in the conventional shift register 10, the D flip-flops driven at the rising edge and the D flip-flops driven at the falling edge are alternately arranged.

The signal generator 20 includes a plurality of logic gates. Specifically, the signal generator 20 includes n NAND gates provided in scan lines S1 to Sn, respectively, and n NOR gates provided in emission control signal lines EM1 to EMn, respectively.

The $k^{th}$ (where 'k' is a natural number less than or equal to n; $k \leqq n$) NAND gate NANDk is driven by the output enable signal OE, the sampling pulse of the $k^{th}$ D flip-flop DFk, and the sampling pulse of the $k-1^{th}$ D flip-flop DFk−1. Here, the output of the $k^{th}$ NAND gate NANDk is supplied to the $k^{th}$ scan line Sk via at least one inverter IN and buffer BU.

The $k^{th}$ NOR gate NORk is driven by the sampling pulse of the $k-1^{th}$ D flip-flop DFk−1 and the sampling pulse of the $k^{th}$ D flip-flop DFk. Here, the output of the $k^{th}$ NOR gate NORk is supplied to the $k^{th}$ emission control line, EMk via at least one inverter IN.

FIG. 2 illustrates waveforms that describe a method of driving the conventional scan driver illustrated in FIG. 1.

Referring to FIG. 2, the clock signal CLK and the output enable signal OE are externally supplied to the scan driver. Here, the period of the output enable signal OE is twice the frequency of the clock signal CLK, and the high voltage periods of the output enable signal OE overlap with the high voltage periods of the clock signal CLK. The output enable signal OE is supplied to control the width of the scan signals SS. Consequently, the width of the scan signals SS is equal to the width of the high voltage period of the output enable signal OE.

When the clock signal CLK is supplied to the shift register 10 and the output enable signal OE is supplied to the signal generator 20, the start pulse SP is externally supplied to the shift register 10 and the signal generator 20.

Specifically, the start pulse SP is supplied to the first D flip-flop, DF1, the first NAND gate NAND1, and the first NOR gate NOR1. The first D flip-flop DF1 that received the start pulse SP is driven at the rising edge of the clock signal CLK to generate a first sampling pulse SA1. The first sampling pulse SA1 generated by the first D flip-flop DF1 is supplied to the first NAND gate NAND1, the first NOR gate NOR1, the second D flip-flop, DF2, and the second NAND gate NAND2.

The first NAND gate NAND1, which received the start pulse SP, the output enable signal OE, and the first sampling pulse SA1, outputs a low voltage when all three supplied signals have a high voltage. Specifically, the first NAND gate NAND1 outputs a low voltage in a period where the first sampling pulse SA1 and the start pulse SP have a high voltage by a period in which the output enable signal OE has a high voltage. The low voltage output from the first NAND gate NAND1 is supplied to the first scan line S1 via a first inverter IN1 and a first buffer BU1. The low voltage supplied to the first scan line S1 is supplied to pixels as the scan signal SS. In the other cases, the first NAND gate NAND1 outputs a high voltage.

The first NOR gate NOR1 that received the start pulse SP and the first sampling pulse SA1 outputs a high voltage when both supplied signals have a low voltage. However, the first NOR gate NOR1 outputs a low voltage when at least one of the start pulse SP and the first sampling pulse SA1 signals has a high voltage. The low voltage output from the first NOR gate NOR1 is subsequently changed into a high voltage through the second inverter IN2, and then supplied to the first emission control signal line EM1. This high voltage supplied to the first emission control signal line EM1 is supplied to the pixels as an emission control signal EMI.

The conventional scan driver repeats the above processes to sequentially supply the scan signals SS to the first $n^{th}$ scan lines S1 to Sn and to sequentially supply the emission control signals EMI to the first $n^{th}$ emission control lines EM1 to EMn. The scan signals SS sequentially select the pixels and the emission control signals EMI control the emission time of the pixels.

In an organic light emitting display, the width of the emission control signals EMI must be freely controlled regardless of the scan signals SS in order to control the brightness of the pixels. Conventionally, the width of the start pulse SP must be increased in order to increase the width of the emission control signals EMI. However, in this case, it is not possible to generate the desired scan signals SS.

The above explanation will be described in detail with reference to FIG. 3, in which the width of the start pulse SP is increased. The width of the start pulse SP must be increased as illustrated in FIG. 3 in order to increase the width of the emission control signals EMI. This occurs because when the width of the start pulse SP increases, the width of the emission control signal EMI, generated by the first NOR gate NOR1 performing a NOR operation on the start pulse SP and the output of the first D flip-flop DF1, increases. However, in this case, the increase in width of the start pulse SP generates undesired scan signals SS. Since the scan signals SS are generated when the start pulse SP, the first sampling pulse SA1, and the output enable signal OE, all have high voltage in the first NAND gate NAND1, the increase in width of the start pulse SP causes a plurality of low voltages to be output from the first NAND gate NAND1. In other words, a plurality of scan signals SS are generated in one frame 1F so that it is not possible to obtain desired scan signals SS.

When the width of the start pulse SP overlaps about two periods of the clock signal CLK, as illustrated in FIG. 3, a plurality of low voltages are output from the first NAND gate NAND1. In the conventional art, since the plurality of scan signals SS are supplied to each of the scan lines S1 to Sn when the width of the start pulse SP increases, the width of the emission control signals EMI is no more than two periods of the clock signal CLK. Also, when the width of the emission control signals EMI increases, non-emission periods increase so that flicker is generated.

SUMMARY OF CERTAIN INVENTIVE ASPECTS

One inventive aspect is a scan driver that freely sets the widths of emission control signals and divides the emission control signals twice in a frame. The scan driver applies the emission control signals to respective emission control lines. Another inventive aspect is an organic light emitting display that uses the scan driver. Yet another inventive aspect is a method of driving the display with this functionality.

In order to achieve the foregoing, in addition to others, according to a first aspect of the present invention, a scan driver is provided comprising a shift register receiving at least two start pulses in one frame to sequentially shift the start pulses in response to a clock signal. This generates at least two sampling pulses {and at least two signal generators combining the at least two sampling pulses and at least two output enable signals with each other to supply scan signals to scan lines. Furthermore, the at least two sampling pulses and at least two signal generators are generated for combining the at least two sampling pulses output from the shift register with each other to supply at least two emission control signals to emission control signals lines in one frame.

Preferably, the signal generators receive different output enable signals equal to the number of start pulses supplied to the scan driver in one frame, so that the number of emission control signals generated by the signal generators in one frame is equal to the number of output enable signals. The at least two signal generators receive different output enable signals. The at least two output enable signals are supplied not to overlap each other. The signal generators comprise NOR gates, an inverter, and NAND gates. The NOR gates are provided in the emission control signal lines to combine the at least two sampling pulses with each other and to thus generate the emission control signals. The inverter is provided for inverting one of the at least two sampling pulses. The NAND gates are provided in the scan lines to combine the sampling pulses generated by the shift register, the inverted sampling pulse, and one of the at least two output enable signals with each other and to thus generate scan signals. The scan driver further comprises at least one inverter connected between the NOR gates and the emission control signals lines. The scan driver further comprises at least one inverter and buffer connected between the NAND gates and the scan lines. D flip-flops driven at the rising edge of the clock signal and D flip-flops driven at the falling edge of the clock signal are alternately arranged in the shift register. The output enable signals input to the NAND gates have higher frequency than the frequency of the clock signal. The period of the output enable signal is ½ of the period of the clock signal.

According to a second aspect of the present invention, an organic light emitting display comprises a pixel unit having at least two scan lines, at least two emission control signal lines, and at least two pixels connected to at least two data lines, a data driver for applying data signals to the data lines, and a specific scan driver.

According to a third aspect of the present invention, a method of driving an organic light emitting display comprises generating at least two sampling pulses using at least two start pulses supplied in response to a clock signal in one frame, inverting the sampling pulses using inverters, combining one of the at least two output enable signals supplied from the outside, the sampling pulses, and the inverted sampling pulses with each other to generate scan signals, and combining the at least two sampling pulses with each other to generate at least two emission control signals supplied to emission control signal lines in one frame.

In one embodiment, the at least two output enable signals are preferably supplied not to overlap each other. Generating the scan signals comprises performing a NAND operation on a $k^{th}$ (k is a natural number) sampling pulse, an inverted $k+1^{th}$ sampling pulse, and one of the at least two output enable signals. Generating the scan signals further comprises performing the NAND operation to invert the generated signal at least once. Generating the emission control signals comprises performing a NOR operation on a $k-1^{th}$ (k is a natural number) sampling pulse (or start pulse) and the $k^{th}$ sampling pulse. Generating the emission control signals further comprises the step of inverting the signal generated by performing the NOR operation at least once. The output enable signals have higher frequency than the frequency of the clock signal. The period of the output enable signals is ½ of the period of the clock signal.

BRIEF DESCRIPTION OF THE DRAWINGS

These and/or other objects and advantages of the invention will become apparent and more readily appreciated from the following description of the preferred embodiments, taken in conjunction with the accompanying drawings of which.

DETAILED DESCRIPTION OF CERTAIN INVENTIVE EMBODIMENTS

Hereinafter, preferred embodiments of the present invention will be described with reference to the attached drawings, that is, FIGS. 4 to 7.

Figure 1:
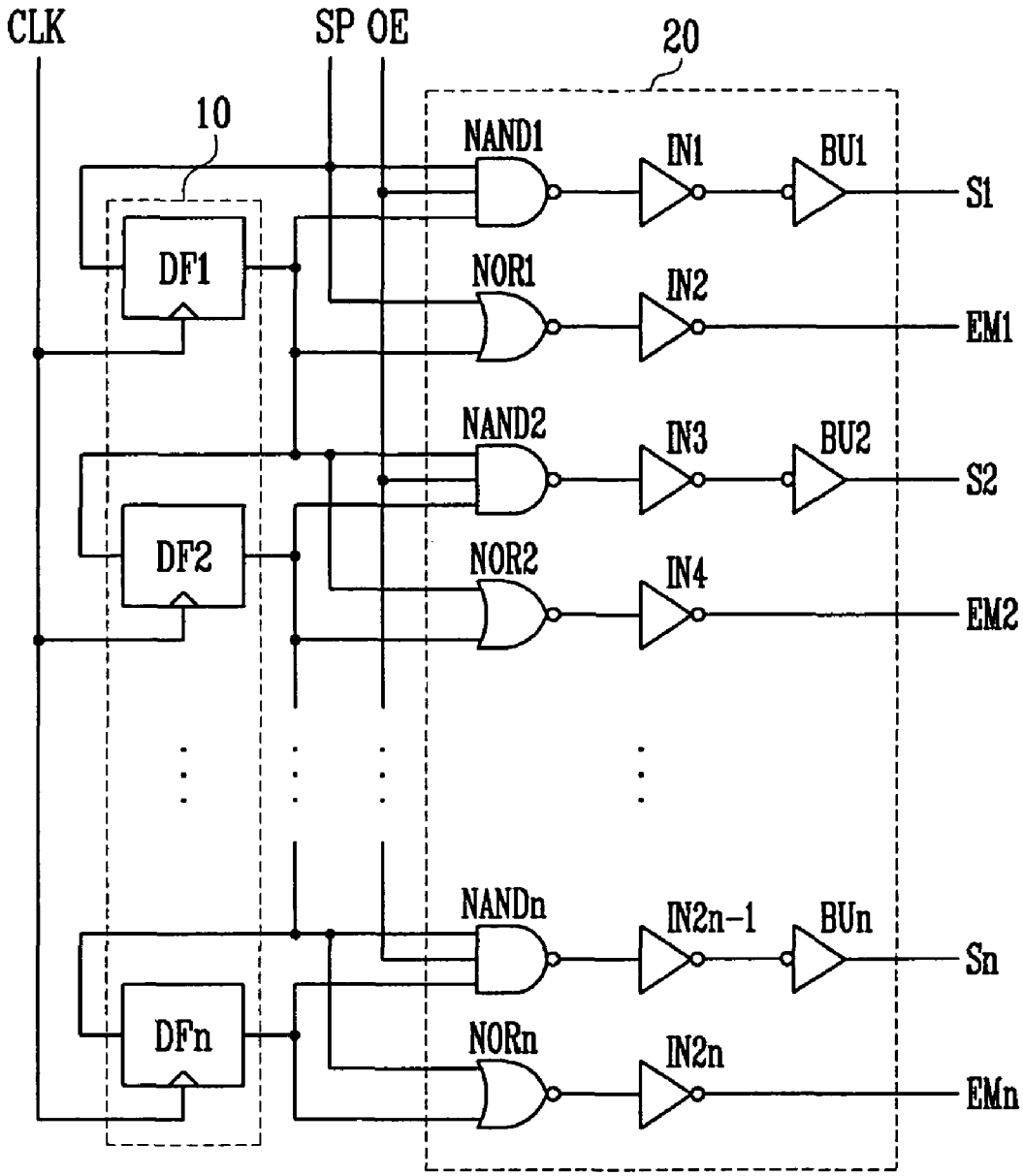
FIG. 1 (PRIOR ART)
FIG. 1 schematically illustrates the structure of a conventional scan driver.
Figure 2:
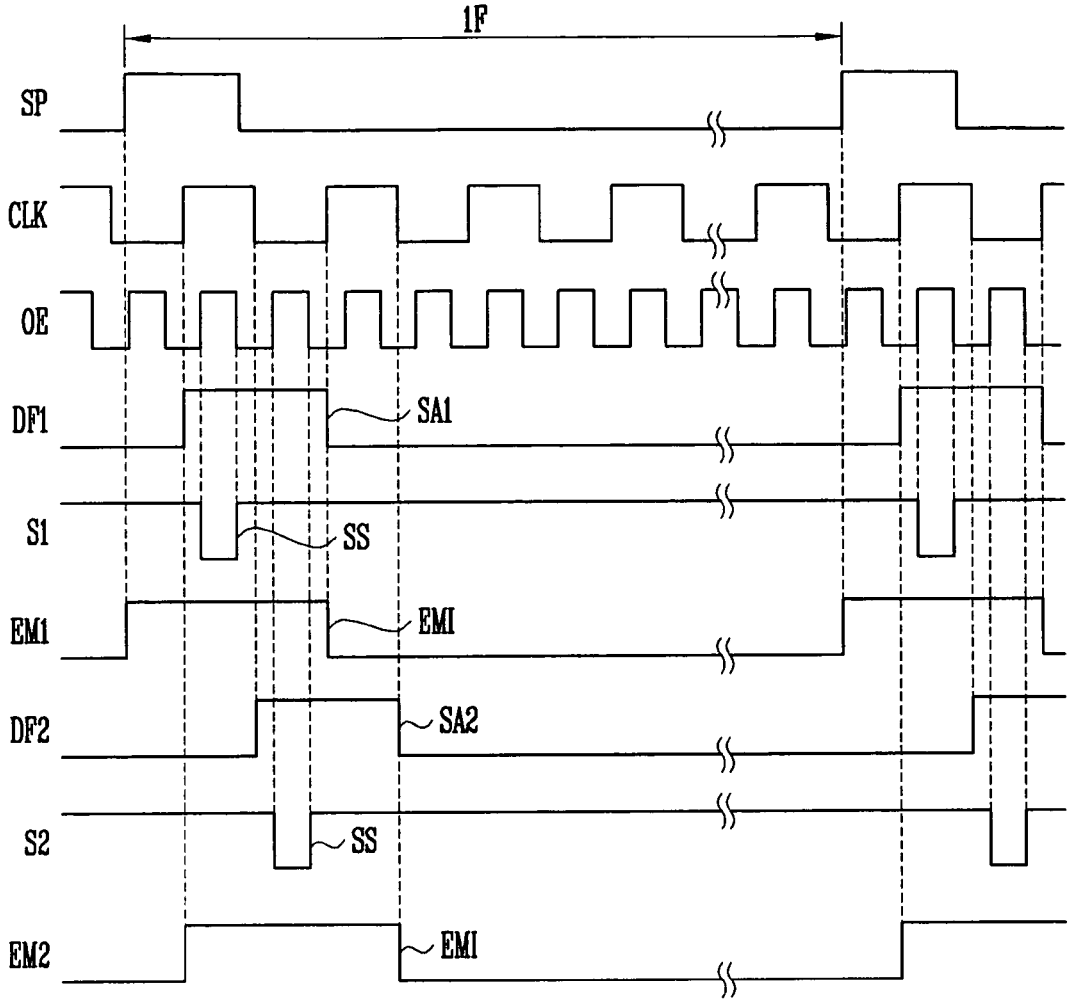
FIG. 2 (PRIOR ART)
FIG. 2 illustrates waveforms that describe a method of driving the scan driver illustrated in FIG. 1.
Figure 3:
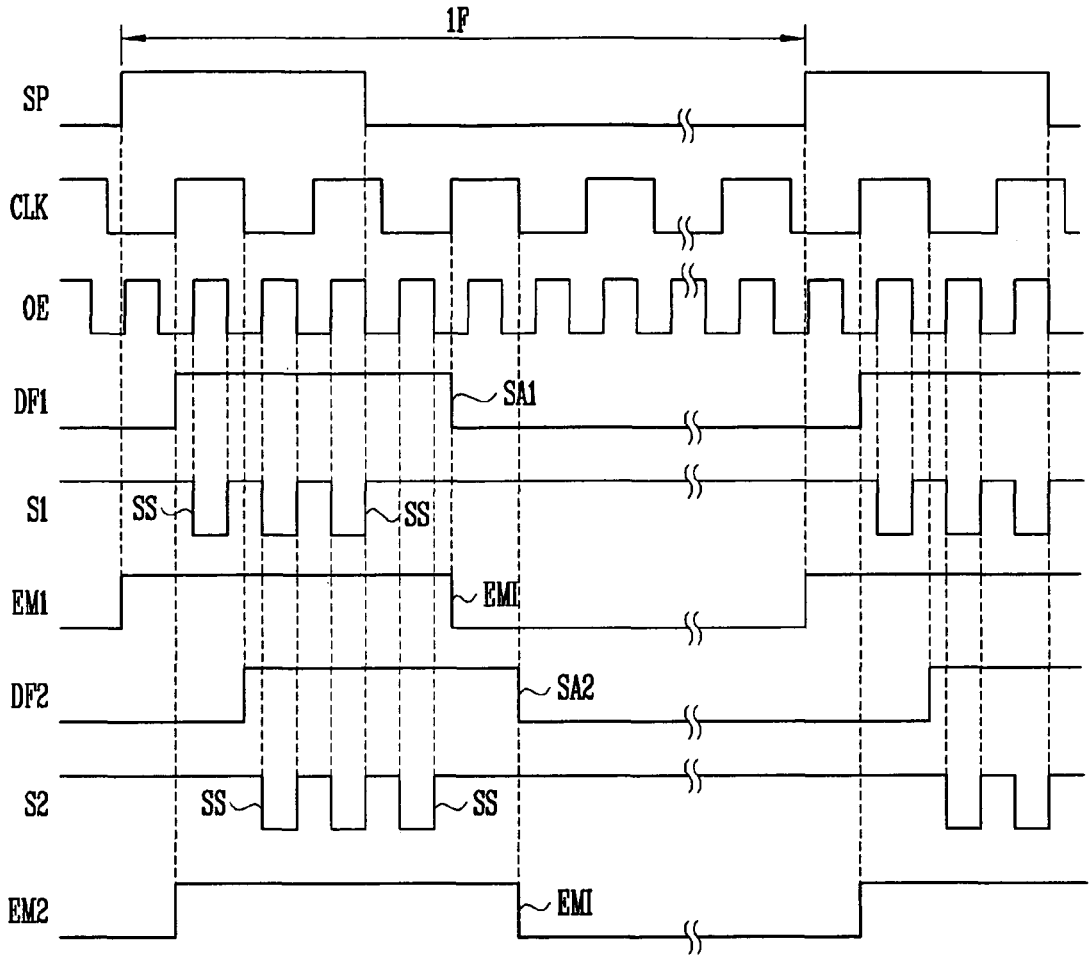
FIG. 3 (PRIOR ART)
FIG. 3 illustrates waveforms that describe scan signals generated when a start pulse whose width is increased is supplied to the scan driver illustrated in FIG. 1.
Figure 4:
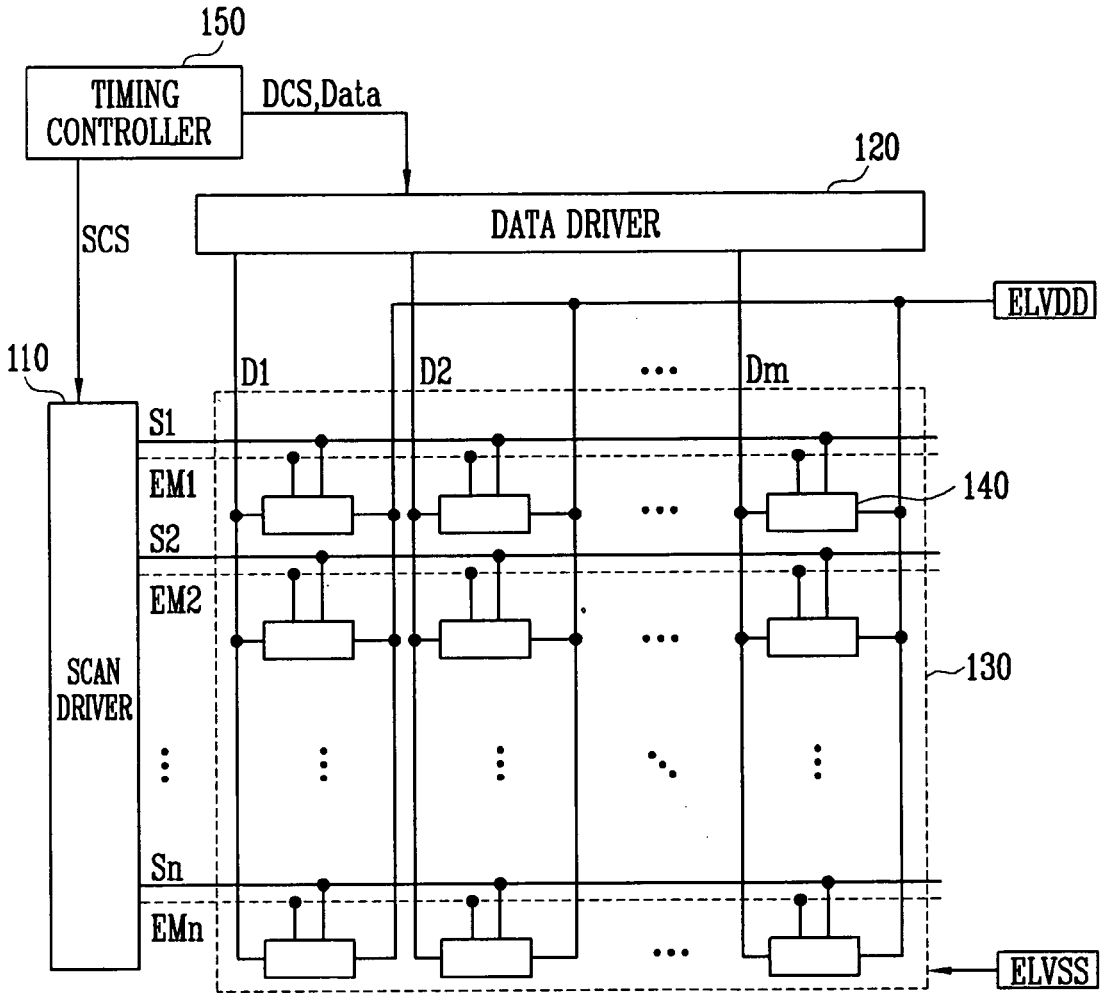
FIG. 4 illustrates an organic light emitting display according to an embodiment of the present invention.

FIG. 4 illustrates the structure of an organic light emitting display according to an embodiment of the present invention.

Referring to FIG. 4, the organic light emitting display according to the embodiment of the present invention includes an image display unit 130 having pixels 140 formed in the regions partitioned by scan lines S1 to Sn and data lines D1 to Dm, a scan driver 110 for driving the scan lines S1 to Sn, a data driver 120 for driving the data lines D1 to Dm, and a timing controller 150 for controlling the scan driver 110 and the data driver 120.

The scan driver 110 receives scan driving control signals SCS from the timing controller 150 to generate the scan signals. The generated scan signals are sequentially supplied to the scan lines S2 to Sn. The scan driver 110 also generates emission control signals in response to the scan driving control signals SCS. The generated emission control signals are supplied to emission control signal lines EM1 to EMn. Here, the scan driver 110 freely sets the width of the emission control signals to control the emission time of the pixels 140. The scan driver 110 supplies the plurality of emission control signals to the emission control lines E, respectively, in one frame, which will be described hereinafter.

The data driver 120 receives data driving control signals DCS from the timing controller 150 to generate the data signals. The generated data signals are supplied to the data lines D1 to Dm in synchronization with the scan signal.

The timing controller 150 generates the scan driving control signals SCS and the data driving control signals DCS in response to synchronizing signals supplied from the outside. The scan driving control signals SCS generated by the timing controller 150 are supplied to the scan driver 110 and the data driving control signals DCS generated by the timing controller 150 are supplied to the data driver 120. The timing controller 150 supplies data Data received from the outside to the data driver 120.

The image display unit 130 receives a first power source ELVDD and a second power source ELVSS from the outside to supply the first and second power sources ELVDD and ELVSS to the pixels 140. The pixels 140 that received the first and second power sources ELVDD and ELVSS generate light components corresponding to the data signals. Here, the emission time of the pixels 140 is controlled by the emission control signals.

Figure 5:
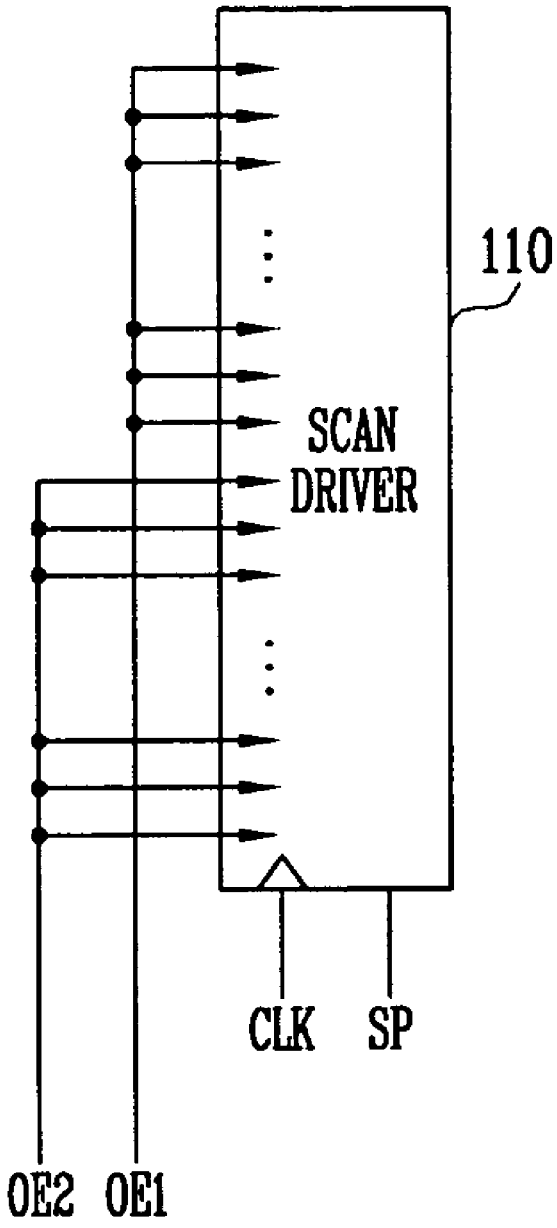
FIG. 5 schematically illustrates a scan driver according to an embodiment of the present invention.

FIG. 5 schematically illustrates the scan driver 110 according to an embodiment of the present invention.

Referring to FIG. 5, according to the embodiment of the present invention, a plurality of output enable signals OE are applied to the scan driver. For convenience sake, FIG. 5 illustrates the scan driver when two output enable signals OE are applied.

Figure 6:
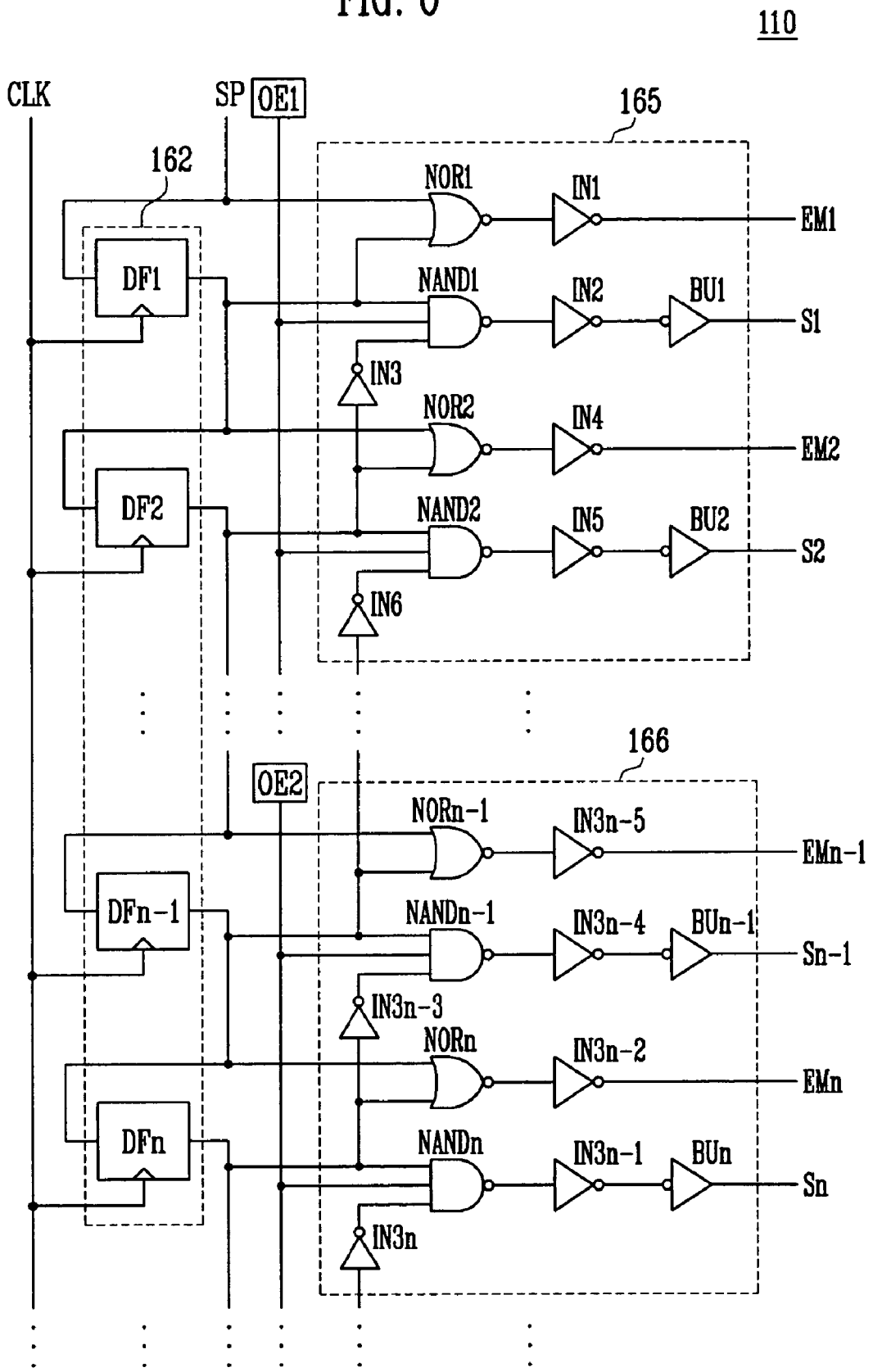
FIG. 6 illustrates the structure of the scan driver illustrated in FIG. 5.

FIG. 6 illustrates the structure of the scan driver illustrated in FIG. 5.

Referring to FIG. 6, the scan driver 110 according to the embodiment of the present invention includes a shift register 162 and two signal generators 165 and 166. The scan driver 110 includes a number of signal generators equal to the number of output enable signals OE applied thereto. Here, the signal generator that receives the first output enable signal OE1 is referred to as the first signal generator 165 and the signal generator that receives the second output enable signal OE2 is referred to as the second signal generator 166. The first and second output enable signals OE1 and OE2 are sequentially applied so that the periods in which the first and second output enable signals OE1 and OE2 are supplied do not overlap.

The shift register 162 sequentially shifts the start pulse SP, which is externally supplied, to generate sampling pulses. The first signal generator 165 combines the sampling pulses (or the start pulse SP) supplied from the shift register 162 and the first output enable signal OE1, which is externally supplied, so as to generate the scan signals and the emission control signals. The second signal generator 166 combines the sampling pulses supplied from the shift register 162 and the second output enable signal OE2, which is externally supplied, so as to generate the scan signals and the emission control signals.

The shift register 162 includes n (where n is a natural number) D flip-flops DF1 to DFn. The shift register 162 sequentially generates sampling pulses using the start pulse SP supplied from the outside in the same manner as the manner in which the conventional shift register 10 sequentially generates sampling pulses. Here, the odd D flip-flops DF1, DF3, . . . are driven at the rising edge of the clock signal CLK and the even D flip-flops DF2, DF4, . . . are driven at the falling edge of the clock signal CLK.

According to aspects of the present invention, the D flip-flops DF1, DF3, . . . driven at the rising edge of the clock signal CLK and the D flip-flops DF2, DF4, . . . driven at the falling edge of the clock signal CLK are alternately arranged in the shift register 162. In another embodiment, and according to aspects of the present invention, the odd D flip-flops DF1, DF3, . . . may be driven at the falling edge of the clock signal CLK and the even D flip-flops DF2, DF4, . . . may be driven at the rising edge of the clock signal CLK.

The first and second signal generators 165 and 166 include a plurality of logic gates. The two signal generators 165 and 166 include a NOR gate NORk provided between a $k^{th}$ (where k is a natural number equal to or smaller than n; $k \leqq n$) D flip-flop DFk and a $k^{th}$ emission control signal line EMk. They also include at least one inverter IN connected between the kth NOR gate NORk and the kth emission control signal line EMk, in order to generate the emission control signals in the same manner as the signal generator 20 of the conventional scan driver generates these signals.

The difference between the scan driver according to the embodiment of the present invention and the conventional scan driver lies in signals input to the NAND gates of the signal generators 165 and 166. In a conventional signal generator, the $k^{th}$ NAND gate NANDk is driven by the output enable signal OE, the sampling pulse of the $k^{th}$ D flip-flop DFk, and the sampling pulse of the $k-1^{th}$ D flip-flop DFk−1. On the other hand, in a signal generator according to the embodiment of the present invention, the $k^{th}$ NAND gate NANDk is driven by one of the output enable signals OE, e.g., OE1 and OE2, the sampling pulse of the $k^{th}$ D flip-flop DFk, and the sampling pulse of an inverted $k+1^{th}$ D flip-flop DFk+1.

To be specific, the first signal generator 165 according to the above embodiment includes the NAND gate NANDk, provided between the $k^{th}$ D flip-flop DFk and the $k^{th}$ scan line Sk, and at least one inverter IN and buffer BU, connected between the NAND gate NANDk and the $k^{th}$ scan line Sk. The $k^{th}$ NAND gate NANDk operates a NAND operation on the sampling pulse of the $k^{th}$ D flip-flop DFk, the first output enable signal OE1, and the sampling pulse obtained by inverting the sampling pulse of a $k+1^{th}$ NAND gate identified as NANDk+1.

The second signal generator 166 includes the NAND gate NANDk, provided between the $k^{th}$ D flip-flop DFk and the $k^{th}$ scan line Sk, and at least one inverter IN and buffer BU, connected between the NAND gate NANDk and the $k^{th}$ scan line Sk. The $k^{th}$ NAND gate NANDk performs a NAND operation on the sampling pulse of the $k^{th}$ D flip-flop DFk, the second output enable signal OE2, and the sampling pulse obtained by inverting the sampling pulse of the $k+1^{th}$ NAND gate NANDk+1. As described above, according to the embodiment of the present invention, it is possible to freely control the width of the emission control signals. The scan driver 110, according to the embodiment of the present invention, which receives the two output enable signals OE1 to OE2 receives the start pulse SP twice in one frame. That is, the scan driver 110 receives a number of start pulses SP equal to the number of received output enable signals OE in one frame. Here, the output enable signal OE is applied twice in order to prevent two scan signals from being generated in one frame, which will be described in detail in FIG. 7.

Figure 7:
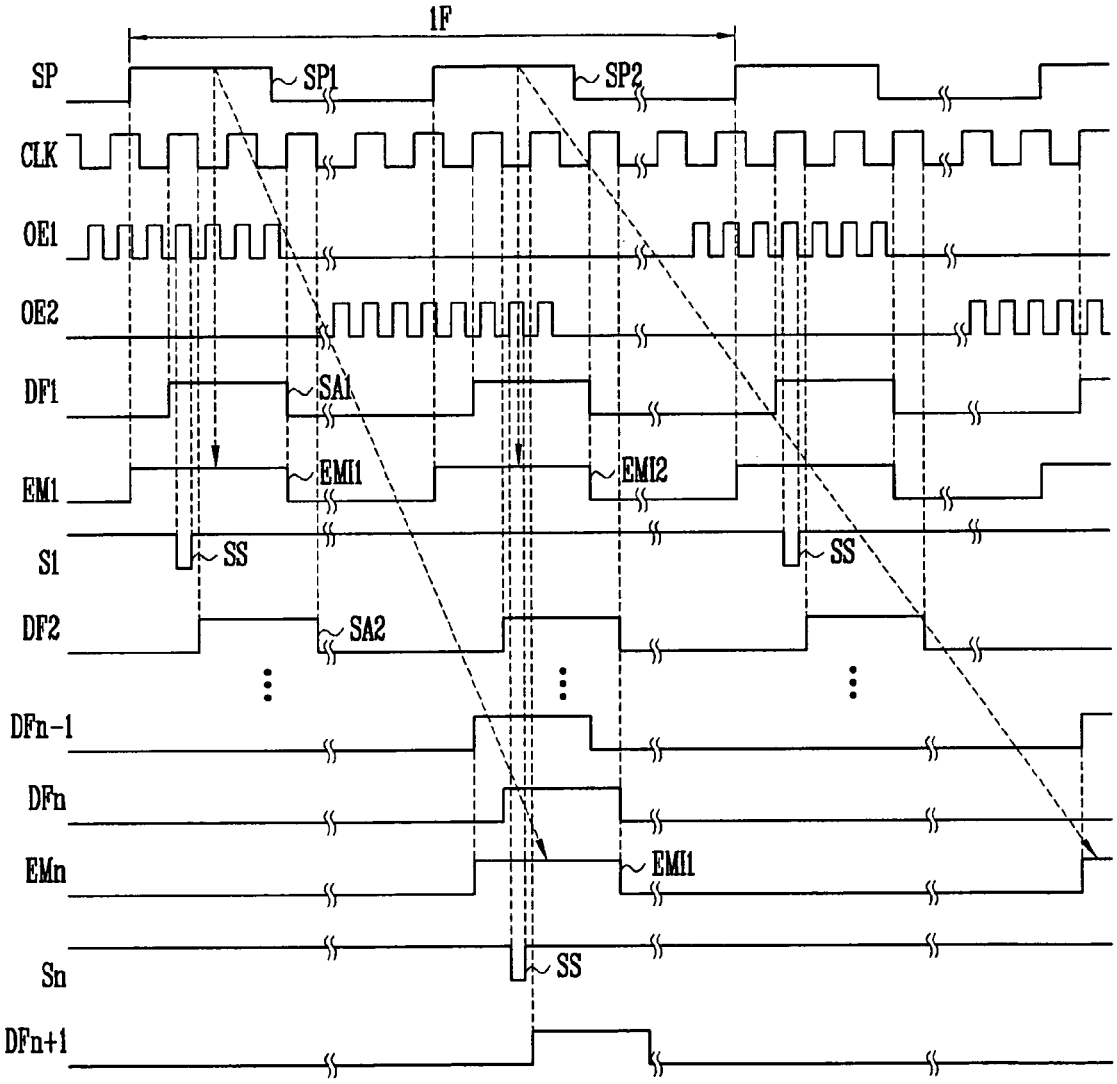
FIG. 7 illustrates waveforms that describe a method of driving the scan driver illustrated in FIG. 6.

FIG. 7 illustrates a method of driving the scan driver illustrated in FIG. 6.

Referring to FIG. 7, the clock signal CLK and the first and second output enable signals OE1 and OE2 are sequentially supplied externally to the scan driver 110. Here, the period of the first and second output enable signals OE1 and OE2 is ½ of the period of the clock signal CLK. The high level voltage of the two output enable signals OE1 and OE2 overlaps the high level voltage of the clock signal CLK.

The clock signal CLK is supplied to the shift register 112, the first output enable signal OE1 is supplied to the first signal generator 165, and the second output enable signal OE2 is supplied to the second signal generator 166. First and second start pulses SP1 and SP2 are sequentially supplied externally to the shift register 162 and the first signal generator 165 in one frame. The first signal generator 165 receives the first output enable signal OE1 to generate the scan signals SS and first and second emission control signals EMI1 and EMI2. The second signal generator 166 receives the second output enable signal OE2 to generate the scan signals SS and the first and second emission control signals EMI1 and EMI2. Here, when the two output enable signals OE1 and OE2 are supplied to the first and second signal generators 165 and 166, the two start pulses SP1 and SP2 are supplied to the scan driver 110 in one frame.

The first start pulse SP1 is supplied to the first D flip-flop DF1 and the first NOR gate NOR1. The first D flip-flop DF1 that received the first start pulse SP1 is driven at the rising edge of the clock signal CLK to generate the first sampling pulse SA1. The first sampling pulse SA1 is supplied to the first NOR gate NOR1, the first NAND gate NAND1, the second D flip-flop DF2, and the second NOR gate NOR2.

The first NOR gate NOR1 performs a NOR operation on the received first start pulse SP1 and first sampling pulse SA1 to generate the first emission control signal EMI1. Here, the width of the emission control signal EMI is equal to or larger than the width of the first start pulse SP1.

The second D flip-flop DF2 that received the first sampling pulse SA1 is driven at the falling edge of the clock signal CLK to generate the second sampling pulse SA2. The second sampling pulse SA2 is input to the first NAND gate NAND1, the second NOR gate NOR2, the second NAND gate NAND2, the third D flip-flop DF3, and the third NOR gate NOR3.

The first NAND gate NAND1 performs a NAND operation on the first sampling pulse SA1, the first output enable signal OE1, and the inverted second sampling pulse SA2 supplied via an inverter IN3. The first NAND gate NAND1 outputs a low level voltage when the first sampling pulse SA1, the first output enable signal OE1, and the inverted second sampling pulse SA2 are all received having a high level voltage, and outputs a high level voltage in the other cases. The first NAND gate NAND1 outputs a low level voltage by the period in which the first output enable signal OE1 has a high level voltage. At this time, the inverted second sampling pulse SA2 is supplied to the first NAND gate NAND1 so that the width of the low level voltage output from the first NAND gate NAND1 is equal to the period in which the first output enable signal OE1 has a high level voltage. That period is half of a period of the first output enable signal OE1, regardless of the width of the emission control signal EMI (or the start pulse SP). The low level voltage output from the first NAND gate NAND1 is supplied to the first scan line S1 via at least one inverter IN2 and buffer BU1, and the first scan line S1 supplies the low level voltage supplied thereto to the pixels 140 as the scan signal SS.

According to the embodiment of the present invention, the above processes are repeated so that the scan driver 110 generates the scan signals SS and the emission control signals EMI. The NAND gates NAND that receive the second output enable signal OE2 combine the second output enable signal OE2 and at least two sampling pulses SA with each other to generate the scan signals SS.

On the other hand, when the second start pulse SP2 is supplied, the first NOR gate NOR1 performs a NOR operation on the second start pulse SP2 and the sampling pulse SA generated by the first D flip-flop to generate the second emission control signal EMI2. That is, according to the above embodiment, the two emission control signals EMI are supplied to the emission control signal lines EM1 to EMn in one frame 1F.

In this case, since the first output enable signal OE1 is not supplied, another scan signal SS is not generated by the first NAND gate NAND1. That is, according to the embodiment of the present invention, although the two start pulses SP1 and SP2 are applied in one frame 1F, only one scan signal SS is generated.

The reason why the plurality of output enable signals OE are applied will now be described in detail. Let us assume that the plurality of start pulses SP are applied in one frame 1F in order to generate the plurality of emission control signals EMI in a state where one output enable signal OE is applied. For example, when the start pulse SP is applied twice in one frame 1F, the two sampling pulses SA are generated. In this case, the signal generator receives the two sampling pulses SA and output enable signals OE to generate the two scan signals SS. That is, the two scan signals SS are supplied to the scan lines S1 to Sn in one frame 1F. However, to prevent the two scan signals SS from being supplied to the scan lines S1 to Sn in one frame 1F, the output enable signals OE (there are as many of these as there are emission control signals EMI which are supplied to the emission control signal lines EM1 to EMn) are sequentially supplied in one frame so that they do not overlap one another.

According to the embodiment of the present invention, the emission control signals EMI applied in one frame 1F are divided at least twice to be applied, and the width of the emission control signals is freely controlled so that it is possible to change brightness without generating flicker on a screen. Also, according to the above embodiment, it is possible to supply stable scan signals SS to the scan lines S1 to Sn regardless of the width of the start pulse SP and the number of times where the start pulse SP is applied in one frame 1F.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. The scope of the invention is indicated by the appended claims rather than by the foregoing description. All changes which come within the meaning and range of equivalency of the claims are to be embraced within their scope.

As described above, in various embodiments, it is possible to freely set the width of the emission control signals and to supply at least two emission control signals to the emission control signal lines in one frame according to the scan driver, the organic light emitting display using the same, and the method of driving the organic light emitting display. Therefore, it is possible to change the brightness of the display without generating a flicker.

What is claimed is:

1. An organic light emitting diode display driver including a scan driver, the scan driver comprising:

a shift register configured to receive a plurality of start pulses in each frame of a plurality of frames, wherein the start pulses are generated external to the scan driver, and wherein the shift register is further configured to sequentially shift the start pulses in response to a clock signal and to thereby generate a plurality of sampling pulses; and a plurality of signal generators configured to combine the sampling pulses and a plurality of output enable signals to supply only one scan pulse to each of a plurality of scan lines during each frame, and also to supply a plurality of emission control pulses to each of a plurality of emission control signal lines during each frame.

2. The organic light emitting diode display driver of claim 1, wherein the signal generators receive the same number of output enable signals as the number of start pulses supplied to the scan driver in one frame, and wherein the number of emission control signals generated by the signal generators in one frame is equal to the number of output enable signals.

3. The organic light emitting diode display driver of claim 1, wherein each of the signal generators receive a different output enable signal.

4. The organic light emitting diode display driver of claim 3, wherein the output enable signals are supplied such that the enabling part of the signals do not overlap.

5. The organic light emitting diode display driver of claim 1, wherein the signal generators comprise:

emission control signal combinational logic configured to combine the sampling pulses with each other and to thereby generate the emission control signals;

an inverter receiving one of the sampling pulses; and scan signal combinational logic configured to combine the sampling pulses generated by the shift register, the inverted sampling pulse, and one of the output enable signals with each other and to thereby generate scan signals.

6. The organic light emitting diode display driver of claim 5, further comprising at least one inverter connected between the emission control signal combinational logic and the emission control signals lines.

7. The organic light emitting diode display driver of claim 5, further comprising at least one inverter and at least one buffer connected between the scan signal combinational logic and the scan lines.

8. The organic light emitting diode display driver of claim 1, wherein the shift register comprises a plurality of D flip-flops driven at the rising edge of the clock signal and a plurality of D flip-flops driven at the falling edge of the clock signal.

9. The organic light emitting diode display driver of claim 5, wherein the output enable signals input to the combinational logic have a higher frequency than the frequency of the clock signal.

10. The organic light emitting diode display driver of claim 9, wherein the period of the output enable signal is ½ of the period of the clock signal.

11. An organic light emitting diode display comprising:

a pixel unit comprising a plurality of pixels connected to a plurality of scan lines, a plurality of emission control signal lines, and a plurality of data lines;

a data driver configured to apply data signals to the data lines; and a scan driver comprising:

a shift register configured to receive a plurality of start pulses in each frame of a plurality of frames, wherein the start pulses are generated external to the scan driver, and wherein the shift register is further configured to sequentially shift the start pulses in response to a clock signal and to thereby generate a plurality of sampling pulses; and a plurality of signal generators configured to combine the sampling pulses and a plurality of output enable signals to supply only one scan pulse to each of a plurality of scan lines during each frame, and also to supply a plurality of emission control pulses to each of a plurality of emission control signal lines during each frame.

12. A method of driving an organic light emitting display, the method comprising:

at a scan driver, configured to receive a plurality of start pulses and a plurality of output enable pulses in each frame of a plurality of frames, wherein the start pulses are generated external to the scan driver;

generating a plurality of sampling pulses in response to the start pulses and in response to a clock signal during one frame;

inverting the sampling pulses;

performing one or more first logic functions on the output enable pulses, the sampling pulses, and the inverted sampling pulses to generate only one scan pulse for each of a plurality of scan lines during the frame; and performing one or more second logic functions on the sampling pulses to also generate a plurality of emission control signals for each of a plurality of emission control signal lines during the frame.

13. The method of claim 12, wherein the output enable signals are supplied such that the enabling part of the signals do not overlap.

14. The method of claim 12, wherein the generating of scan signals comprises generating a $k^{th}$ sampling pulse, an inverted $k+1^{th}$ sampling pulse, and one of the output enable signals.

15. The method of claim 14, wherein the generating of scan signals further comprises inverting a signal at least once.

16. The method of claim 12, wherein the step of generating the emission control signals comprises performing a combinational logic operation on a $k-1^{th}$ sampling pulse and the $k^{th}$ sampling pulse, where k is a natural number.

17. The method of claim 16, wherein the generating of emission control signals further comprises inverting the signal generated by performing the NOR operation at least once.

18. The method of claim 14, wherein the output enable signals have higher frequency than the frequency of the clock signal.

19. The method of claim 18, wherein the period of the output enable signals is less than the period of the clock signal.

20. An organic light emitting diode display driver including an emission driver, comprising:

a plurality of OLEDs arranged in rows;

a plurality of scan lines, each line connected to one row of the OLEDs;

a plurality of emission control lines, each emission control line connected to one row of the OLEDs;

a plurality of output enable lines; and a scan driver configured to provide scan and emission control signals, respectively, to the scan lines and emission control lines, the scan driver being configured to receive a plurality of start pulses in each frame of a plurality of frames, wherein the start pulses are generated external to the scan driver, wherein only one scan pulse is provided for each of the scan lines during one frame based on the start pulses, and wherein a plurality of emission control signals are also provided to each of the emission control lines during the frame.

21. The organic light emitting diode display driver of claim 1, wherein the signal generators each comprise:

a first set of combinational logic configured to generate first scan and emission control signals for first scan and emission control lines, respectively; and a second set of combinational logic configured to generate second scan and emission control signals for second scan and emission control lines, respectively, wherein a signal generated by the second set of combinational logic is input to the first set of combinational logic.

22. An organic light emitting diode display emission driver configured to receive during each frame a plurality of start pulses, a clock signal, and a plurality of output enable signals, and, in response to the start pulses, the clock signal, and the output enable signals, to generate for each scan line of the display only one scan pulse and a plurality of emission control pulses during each frame, the emission driver comprising:

a shift register, configured to sequentially shift the start pulses in response to the clock signal and to thereby generate a plurality of sampling pulses; and a plurality of signal generators configured to receive the sampling pulses and the output enable signals, and based on the sampling pulses and the output enable signals to generate the one scan pulse per scan line per frame and to generate the plurality of emission control pulses per scan line per frame, wherein the duration of the emission control pulses is based on the duration of the start pulses, and the duration of at least one of the start pulses is greater than two periods of the clock signal.

* * * * *